US006691877B1

(12) United States Patent
Ohm

(10) Patent No.: US 6,691,877 B1
(45) Date of Patent: Feb. 17, 2004

(54) ARCHERY BOW RACK

(76) Inventor: Robert J. Ohm, 1109 N. Chester St., Sparta, WI (US) 54656

( * ) Notice: Subject to any disclaimer, the term of this patent is extended or adjusted under 35 U.S.C. 154(b) by 0 days.

(21) Appl. No.: 10/291,094

(22) Filed: Nov. 7, 2002

(51) Int. Cl.[7] ..... A47F 7/00
(52) U.S. Cl. ..... 211/85.7
(58) Field of Search ..... 211/85.7, 89.01, 211/60.01, 67, 68

(56) References Cited

U.S. PATENT DOCUMENTS

| | | | | | |
|---|---|---|---|---|---|
| 3,082,878 | A | * | 3/1963 | Thomas | 211/60.1 |
| 4,003,612 | A | * | 1/1977 | Munsell | 312/245 |
| 4,176,752 | A | * | 12/1979 | Taber | 211/120 |
| 4,331,311 | A | | 5/1982 | Russell | |
| 4,360,139 | A | | 11/1982 | Wendt | |
| 4,450,967 | A | * | 5/1984 | Castro | 211/85.7 |
| 4,474,296 | A | | 10/1984 | Hartman | |
| 4,542,873 | A | | 9/1985 | Matherly | |
| 5,005,710 | A | * | 4/1991 | Hofer | 211/70.6 |
| 5,048,504 | A | | 9/1991 | Ballard | |
| 5,137,319 | A | * | 8/1992 | Sauder | 294/159 |
| 5,370,240 | A | * | 12/1994 | Hand | 211/13.1 |
| 5,482,241 | A | | 1/1996 | Oglesby | |
| 6,244,556 | B1 | | 6/2001 | Carrillo et al. | |

* cited by examiner

*Primary Examiner*—Alvin Chin-Shue
*Assistant Examiner*—Sarah Purol
(74) *Attorney, Agent, or Firm*—Robert J. Harter

(57) ABSTRACT

An archery bow rack includes a lower support member for supporting the bow's weight, and an upper catch with a movable surface for restraining the bowstring, such that the bow is held generally upright. The catch and lower support member are such that a number of bows can be stored in the rack with minimal side clearance between adjacent bows, as the bows can be inserted or removed in straight in or out motion. In some embodiments, the catch snaps into a string-restraining position in response to forcing the bowstring into the catch.

23 Claims, 10 Drawing Sheets

ARCHERY BOW RACK

BACKGROUND OF THE INVENTION

1. Field of the Invention

The subject invention generally pertains to archery bows and more particularly to a rack for efficiently storing or displaying such bows 2. Description of Related Art Current racks for holding archery bows use various hooks, clamps and other bow-holding devices, wherein the bow needs to be manipulated in various directions in order to insert or remove the bow from the rack. This can be a problem where a number of bows need to be stored or displayed within a limited area, which is common in storage cabinets and stores that sell bows. When bows are to be arranged in a side-by-side relationship, extra side clearance between adjacent bows may be needed to allow the bow to move sideways, so that the bow and/or bowstring can be hooked around a fixed hook or engage another type of holding device.

Some bow-holding devices grip the bow itself, which can scratch the surface of the bow.

Other bow-holding devices include protruding mechanical hardware that can be unsightly, difficult to dust, and not easily hidden within fine wooden cabinetry.

Still other methods involve simply dangling the bow from a hook, whereby the lower ends of adjacent bows can bang together, sometimes in a chain reaction.

Consequently, there is a need for an improved device for holding archery bows

SUMMARY OF THE INVENTION

To overcome the problems and limitation of current bow-holding devices, it is an object of the invention to provide a rack that can hold archery bows in generally upright, side-by-side arrangement.

Another object is to provide a rack that can efficiently hold a number of bows with a minimum of side clearance between adjacent bows.

Another object is to support an archery bow in an upright position by engaging its bowstring with a device that does not require the string to be moved sideways.

Another object is to enable a bow to be inserted and removed from a rack with a straight in/out linear motion.

Another object is to engage a bowstring with a roller to minimize string wear in the area of engagement.

Another object is to provide a bow-holding device that lends itself well to mounting in various arrangements including within an attractive display cabinet.

Another object is to provide a bow-holding device that provides a snap-in action that the user can feel, so the user knows when the bow becomes fully engaged within the device.

Another object is to provide a bow-holding device with an adjustment that can adjust the bowstring holding force to meet requirements such as bow weight, bowstring thickness, and user preference.

Another object is to provide a bow-holding device that requires a greater force to remove the bow than to insert it.

One or more of these and/or other objects of the invention are provided by a rack for storing an archery bow, wherein the rack includes a lower support member for supporting most of the bow's weight, and a catch with a movable surface for restraining the bowstring, such that the bow is held generally upright.

DESCRIPTION OF THE PREFERRED EMBODIMENT

Figure 12A:
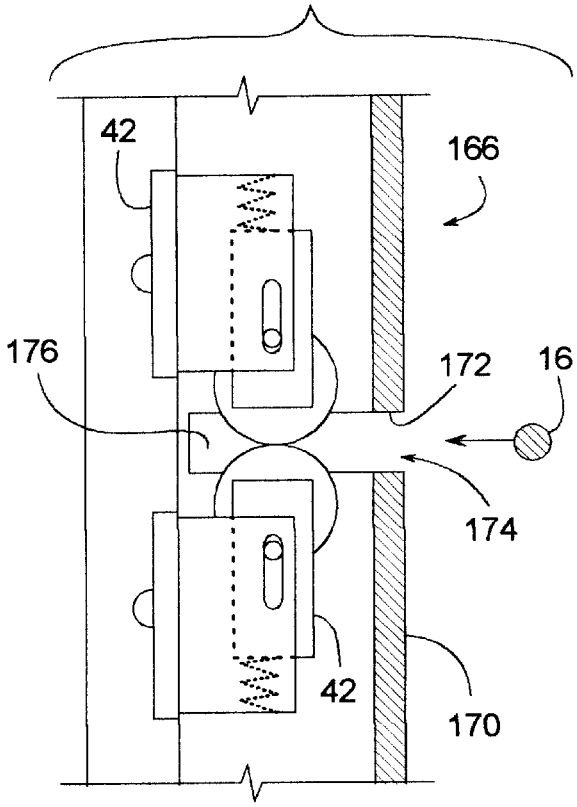
FIG. 12*a* is a cross-sectional view taken along line 12*a*—12*a* of FIG. 12*d*.
Figure 12B:
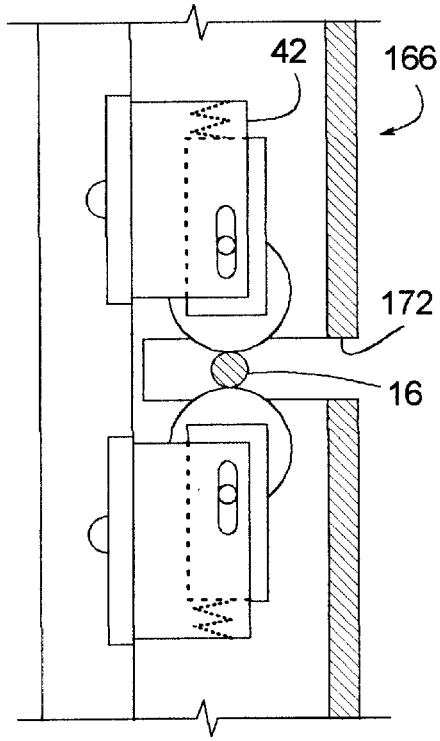
FIG. 12*b* is similar to FIG. 12*a* but showing the bowstring pinched within the string-passageway, which is currently at its more open position.
Figure 12C:
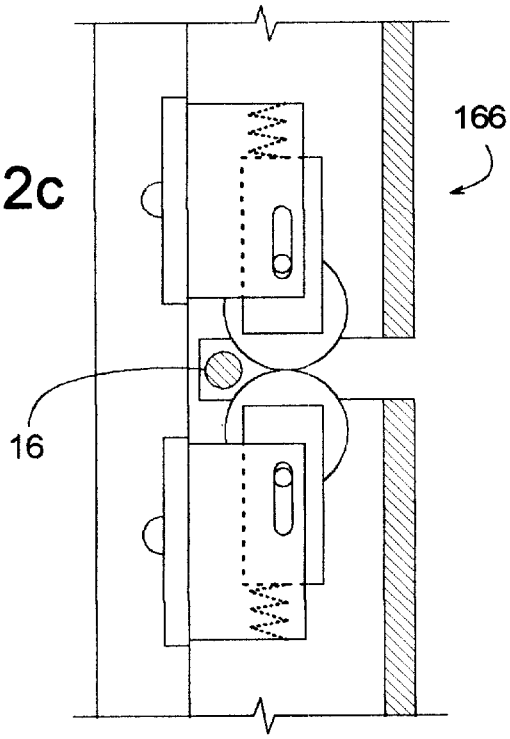
FIG. 12*c* is similar to FIG. 12*a*, but showing the bowstring constrained within the string-capturing area.
Figure 12D:
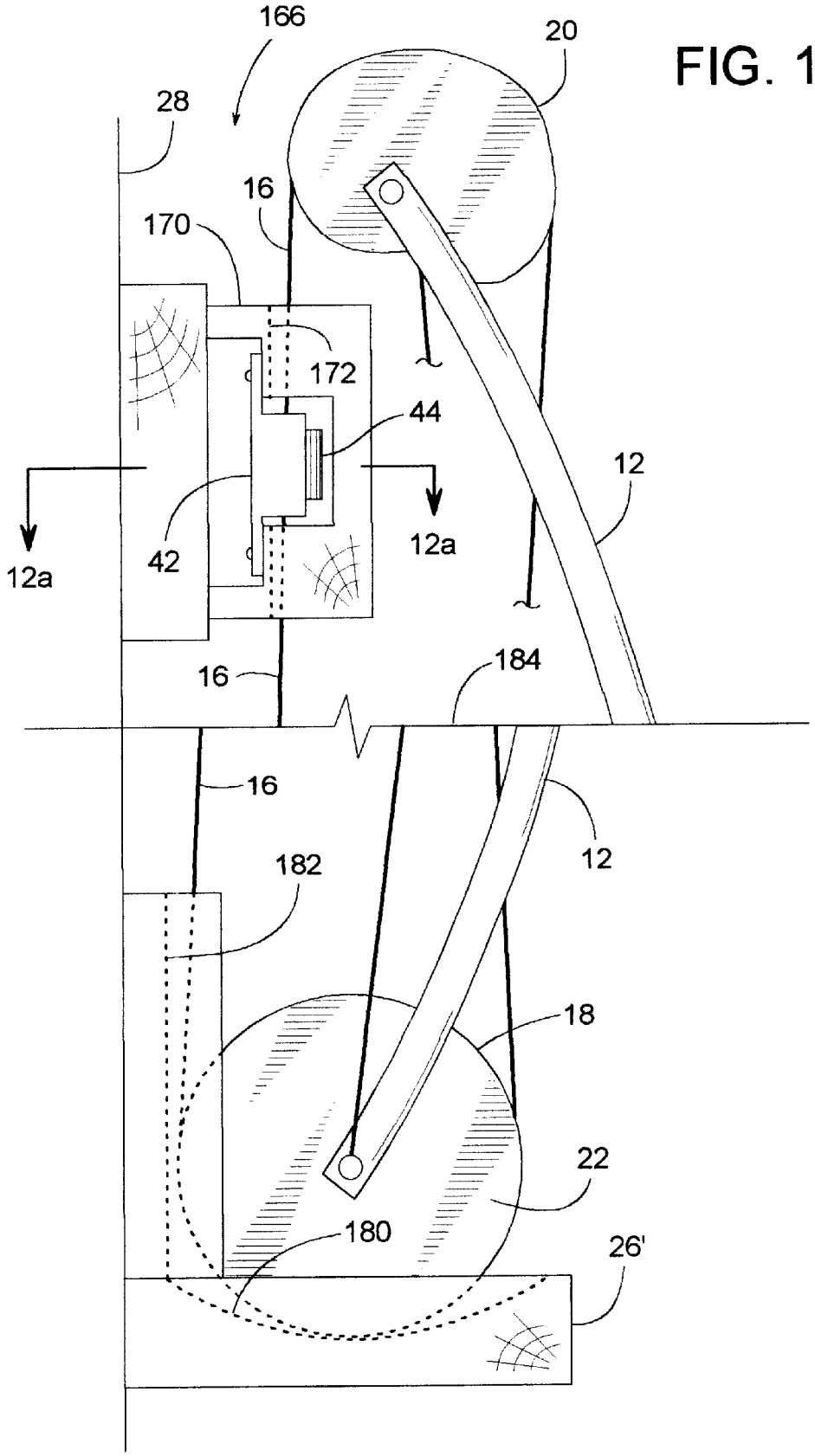
FIG. 12*d* is a side view of a bow mounted in a rack, wherein a central portion of the drawing is omitted to show certain features of the invention.

FIGS. 1, 2, 3*a*, 3*b*, and 3*c* illustrate a rack 10 for storing an archery bow 12 that includes a bow 14 and a bowstring 16. In the case where bow 12 is a compound bow, bow 12 may further include a sheave 18, such as a cam 20 or a roller 22, as shown in FIG. 12*d*. Rack 10 comprises a catch 24 and a lower support member 26 upon which bow 12 may rest its weight. Catch 24 and/or lower support member 26 can be attached to a mounting surface 28, such as a wall, cabinet, stand, etc.

Figure 1:
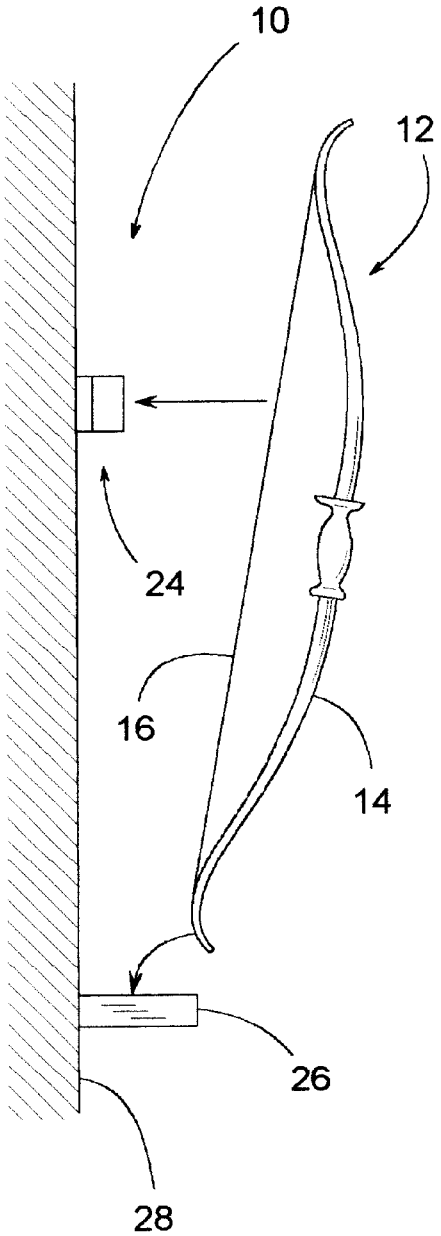
FIG. 1 is a side view showing a bow being placed in a rack according to one embodiment of the invention.
Figure 2:
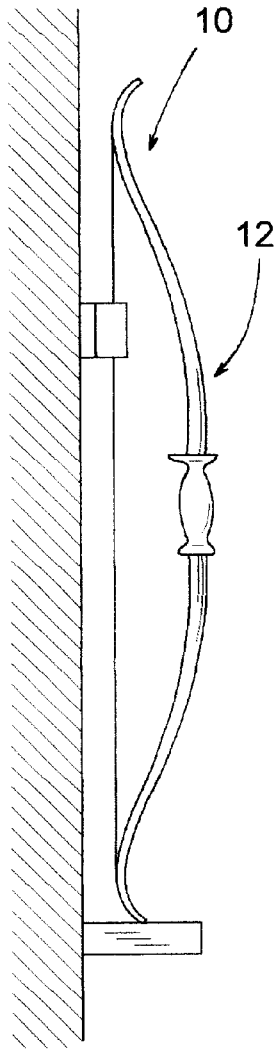
FIG. 2 is a side view similar to FIG. 1 but showing the bow installed in the rack.
Figure 3A:
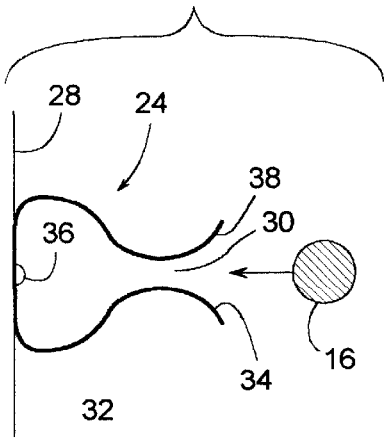
FIG. 3*a* is a top view of the catch of FIGS. 1 and 2 showing the bowstring about to be inserted through a string-passageway that is currently at its less open position.
Figure 3B:
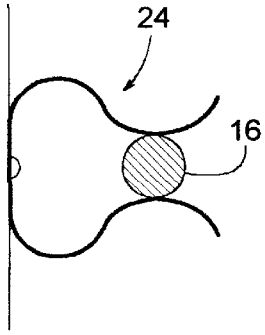
FIG. 3*b* is a top view similar to FIG. 3*a* but showing the bowstring pinched within the string-passageway, which is currently at its more open position.
Figure 3C:
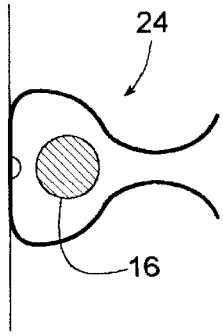
FIG. 3*c* is a top view similar to FIG. 3*a*, but showing the bowstring constrained within the string-capturing area.

Catch 24 defines a string-passageway 30 leading to a string-capturing area 32. A surface 34 on catch 24 is movable to vary the string-passageway from being less open (FIGS. 3*a* and 3*c*) to more open (FIG. 3*b*). The less open position helps hold bowstring 16 within string-capturing area 32. The less open position can be tightly closed or open so slightly that surface 34 is still able to block the escape of the bowstring from within area 32. The more open position allows bowstring 16 to be inserted into or removed from within area 32. Bowstring 16 can move unimpeded by some embodiments of the string-passageway. In other embodiments, however, bowstring 16 may need to be forced through the string-passageway, whereby bowstring 16 deflects or otherwise moves catch 24 to open the string-passageway. The movement of surface 34 can be achieved by various structure including, but not limited to, surface 34 being made of or mounted to a resilient member or material (e.g., sheet metal, plastic, spring steel, etc.), surface 34 being part of a roller, surface 34 being part of a movable latch (e.g., movable strap, bar, hook, flap, magnet, clip, snap, etc.). For the embodiment of FIGS. 3*a*–3*b*, catch 24 comprises one or more curved pieces of resilient metal that a fastener 36 attaches to mounting surface 28 or to another structural member. Catch 24 may be provide with a lead-in 38 (beveled or curved) to help bowstring 16 into the string-passageway.

Figure 4A:
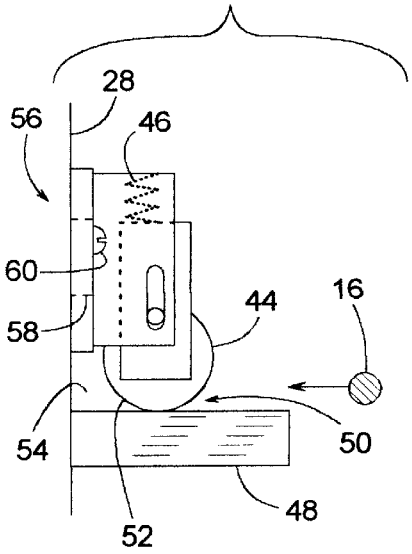
FIG. 4*a* is a top view similar to FIG. 3*a* but of another embodiment.
Figure 4B:
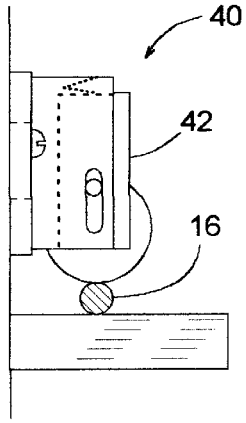
FIG. 4*b* is a top view similar to FIG. 3*b* but of another embodiment.
Figure 4C:
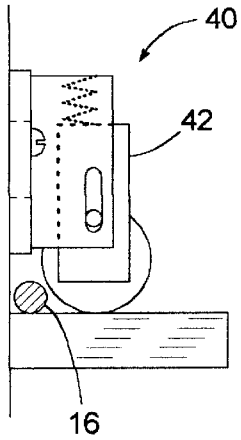
FIG. 4*c* is a top view similar to FIG. 3*c* but of another embodiment.

In another embodiment, shown FIGS. 4*a*, 4*b* and 4*c*, a catch 40 includes a roller assembly 42. Roller assembly 42 includes a roller 44 that a spring 46 urges toward another member 48 of catch 40. Member 48 is schematically illustrated to represent any structure that helps define a string-passageway 50 between itself and a movable surface 52 of roller 44, wherein string-passageway 50 leads to a string-capturing area 54. Examples of member 48 include, but are not limited to, a bar, block, plate, or another roller (spring loaded or fixed position). Surface 52 is movable to vary string-passageway 50 from being less open (FIGS. 4*a* and 4*c*) to being more open (FIG. 4*b*). Catches 40 and 24 are similar with FIGS. 4*a*, 4*b* and 4*c* corresponding to FIGS. 3*a*, 3*b*, and 3*c* respectively.

To provide catch 40 with an adjustment 56 that determines the effort that may be needed to force bowstring 16 through the string-passageway, catch 40 may be provided with oblong mounting holes 58 through which fasteners 60 extend for attaching catch 40 to mounting surface 28. In some cases, the location of fasteners 60 within holes 58 can determine how close surface 52 is to member 48 when passageway 50 is less open. In cases where roller 44 touches member 48 in the less open position, the location of fastener 60 within holes 58 can determine how much preload is applied to spring 46. In other words, adjustment 56 can determine a force that may need to be exerted in a normal direction against surface 52 to vary the spring-passageway from being less open to more open. It should be noted that adjustment 56 is just one example of an adjustment for varying the operating force of a catch, and numerous versions of adjustment 56 can be applied to various embodiments of the invention.

Figure 5A:
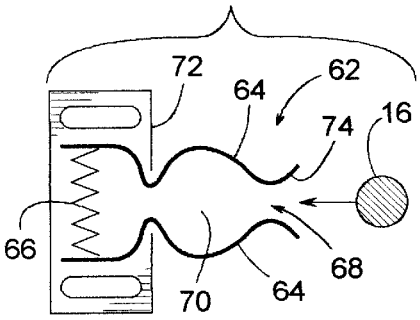
FIG. 5*a* is a top view similar to FIG. 3*a* but of another embodiment.
Figure 5B:
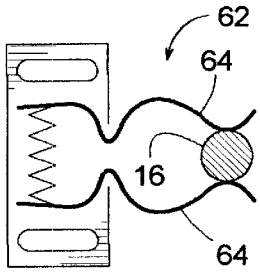
FIG. 5*b* is a top view similar to FIG. 3*b* but of another embodiment.
Figure 5C:
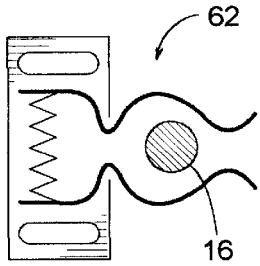
FIG. 5*c* is a top view similar to FIG. 3*c* but of another embodiment.

In another embodiment, shown in FIGS. 5*a*, 5*b* and 5*c*, a catch 62 includes two clips 64 that a spring 66 urges toward each other. Clips 64 define a string-passageway 68 that leads to a string-capturing area 70. Clips 64 are movable within a housing 72 so that a surface 74 can move to vary string-passageway 68 from being less open (FIGS. 5*a* and 5*c*) to being more open (FIG. 5*b*). Catches 62 and 24 are similar with FIGS. 5*a*, 5*b* and 5*c* corresponding to FIGS. 3*a*, 3*b*, and 3*c* respectively.

Figure 6A:
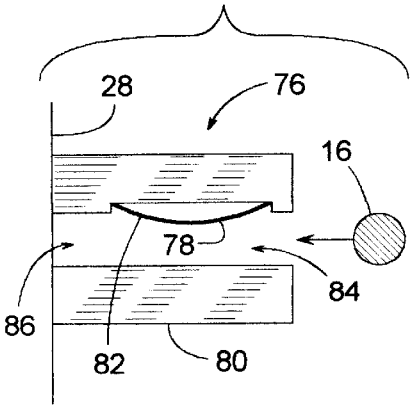
FIG. 6*a* is a top view similar to FIG. 3*a* but of another embodiment.
Figure 6B:
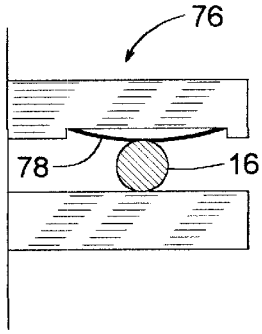
FIG. 6*b* is a top view similar to FIG. 3*b* but of another embodiment.
Figure 6C:
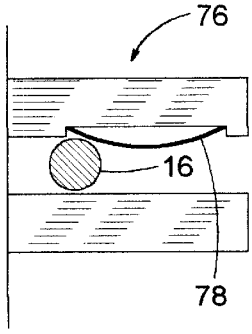
FIG. 6*c* is a top view similar to FIG. 3*c* but of another embodiment.

In another embodiment, shown FIGS. 6*a*, 6*b* and 6*c*, a catch 76 includes a leaf spring 78 that urges itself toward another member 80 of catch 76. Member 80 is schematically illustrated to represent any structure that helps define a string-passageway 84 between itself and a movable surface 82 of leaf spring 78, wherein string-passageway 84 leads to a string-capturing area 86. Examples of member 80 include, but are not limited to, a bar, block, plate, roller, or another leaf spring. Surface 82 is movable to vary string-passageway 84 from being less open (FIGS. 6*a* and 6*c*) to being more open (FIG. 6*b*). Catches 76 and 24 are similar with FIGS. 6*a*, 6*b* and 6*c* corresponding to FIGS. 3*a*, 3*b*, and 3*c* respectively.

Figure 7A:
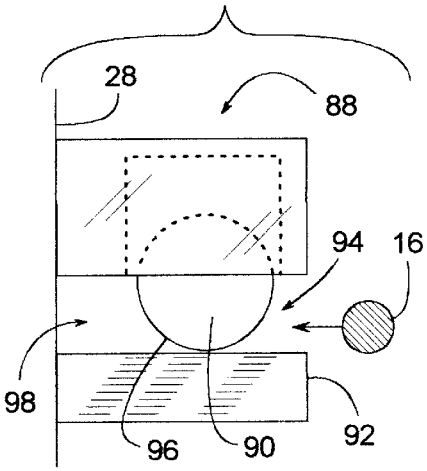
FIG. 7*a* is a top view similar to FIG. 3*a* but of another embodiment.
Figure 7B:
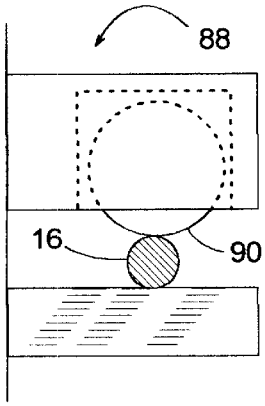
FIG. 7*b* is a top view similar to FIG. 3*b* but of another embodiment.
Figure 7C:
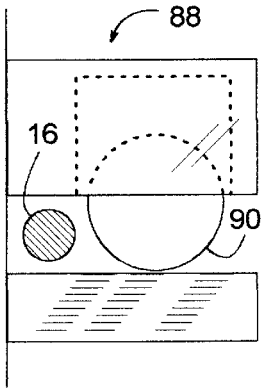
FIG. 7*c* is a top view similar to FIG. 3*c* but of another embodiment.

In another embodiment, shown FIGS. 7*a*, 7*b* and 7*c*, a catch 88 includes a magnet 90 that urges itself toward another member 92 of catch 88. Member 92 is schematically illustrated to represent any structure that is drawn to a magnet and helps define a string-passageway 94 between itself and a movable surface 96 of magnet 90, wherein string-passageway 94 leads to a string-capturing area 98. Examples of member 92 include, but are not limited to, a ferrous bar, block, plate, roller, or another magnet. Surface 96 is movable to vary string-passageway 94 from being less open (FIGS. 7*a* and 7*c*) to being more open (FIG. 7*b*). Catches 88 and 24 are similar with FIGS. 7*a*, 7*b* and 7*c* corresponding to FIGS. 3*a*, 3*b*, and 3*c* respectively.

Figure 8A:
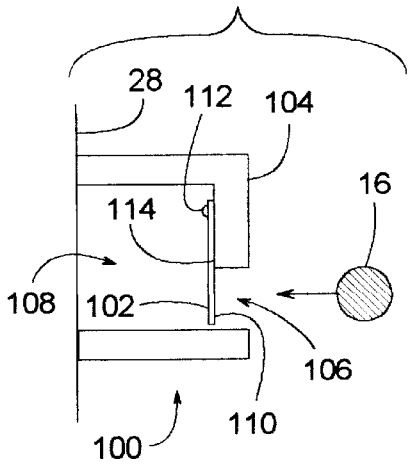
FIG. 8*a* is a top view similar to FIG. 3*a* but of another embodiment.
Figure 8B:
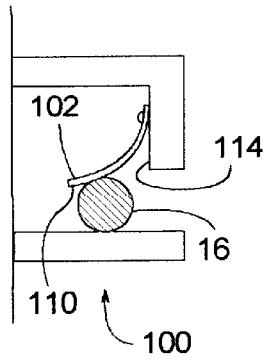
FIG. 8*b* is a top view similar to FIG. 3*b* but of another embodiment.
Figure 8C:
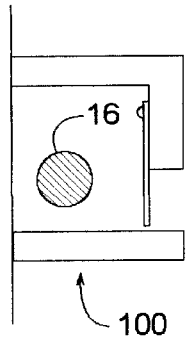
FIG. 8*c* is a top view similar to FIG. 3*c* but of another embodiment.

In another embodiment, shown in FIGS. 8*a*, 8*b* and 8*c*, a catch 100 includes a resilient strap 102 (e.g., a strap made of plastic, rubber, spring steel, etc) attached to a housing 104. Housing 104 defines a string-passageway 106 that leads to a stringcapturing area 108. Strap 102 is movable so that a surface 110 of strap 106 can move to vary string-passageway 106 from being less open (FIGS. 8*a* and 8*c*) to being more open (FIG. 8*b*). Due to the distance between a strap mounting point 112 and an edge 114 of housing 104, bowstring 16 may be easier to insert in area 108 than to remove from area 108 (i.e., more force may be needed to pull bowstring 16 out from within area 108). Catches 100 and 24 are similar with FIGS. 8*a*, 8*b* and 8*c* corresponding to FIGS. 3*a*, 3*b*, and 3*c* respectively.

Figure 9A:
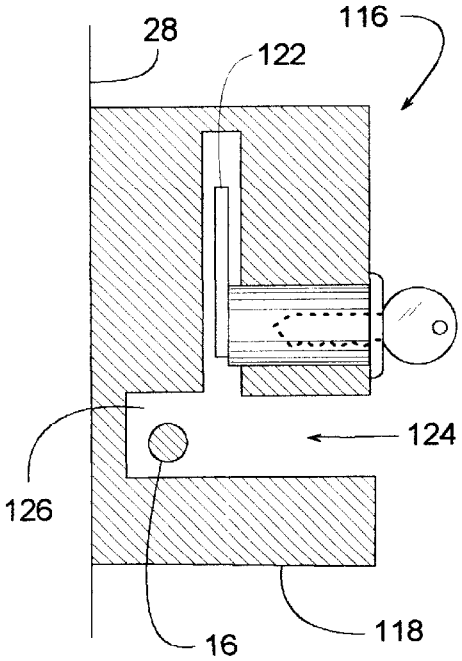
FIG. 9*a* is a top view similar to FIG. 3*a* but of another embodiment.
Figure 9B:
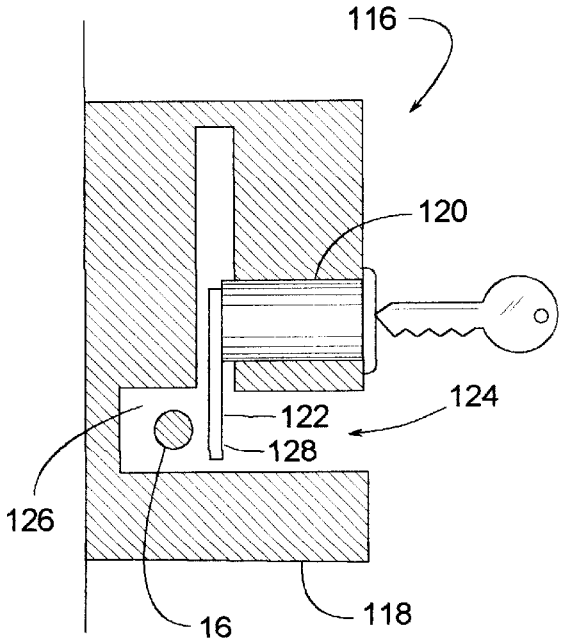
FIG. 9*b* is a top view similar to FIG. 3*c* but of another embodiment.

In another embodiment, shown in FIGS. 9*a* and 9*b*, a catch 116 includes a housing 118 with a keyed lock 120 that can turn a pawl 122 to selectively open and close a string-passageway 124 defined by housing 118. String-passageway 124 leads to a string-capturing area 126, which is also defined by housing 118. Pawl 122 is movable within housing 118 so that a surface 128 of pawl 122 can move to vary string-passageway 124 from being less open (FIG. 9*b*) to being more open (FIG. 9*a*). Catches 116 and 24 are similar with FIGS. 9*a*, 9*b* corresponding to FIGS. 3*a* and 3*c* respectively.

Figure 10A:
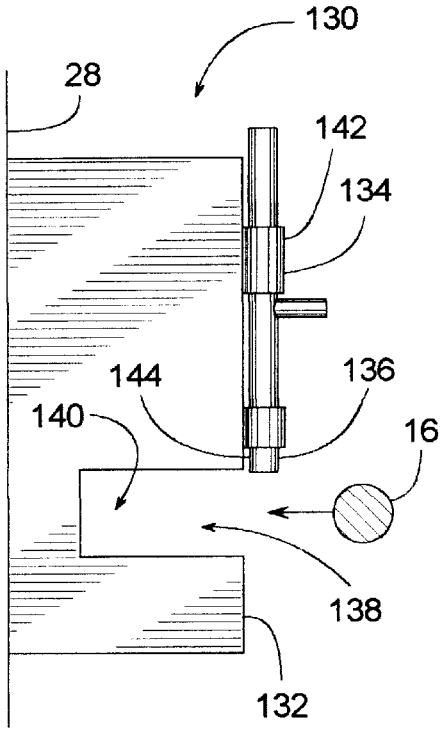
FIG. 10*a* is a top view similar to FIG. 9*a* but of another embodiment.
Figure 10B:
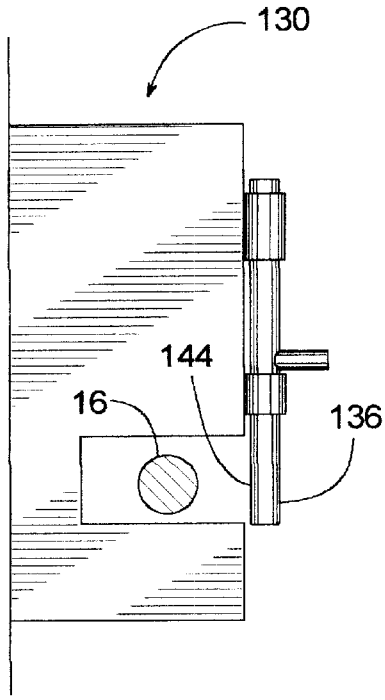
FIG. 10*b* is a top view similar to FIG. 9*c* but of another embodiment.

In another embodiment, shown in FIGS. 10*a* and 10*b*, a catch 130 includes a housing 132 with a sliding latch 134 that can move a deadbolt 136 to selectively open and close a string-passageway 138 defined by housing 132. String-passageway 138 leads to a string-capturing area 140, which is also defined by housing 132. Deadbolt 136 is movable within a guide member 142 so that a surface 144 of deadbolt 136 can move to vary string-passageway 138 from being more open (FIG. 10*a*) to being less open (FIG. 10*b*). Catches 130 and 116 are similar with FIGS. 10*a*, 10*b* corresponding to FIGS. 9*a* and 9*b* respectively.

Figure 11A:
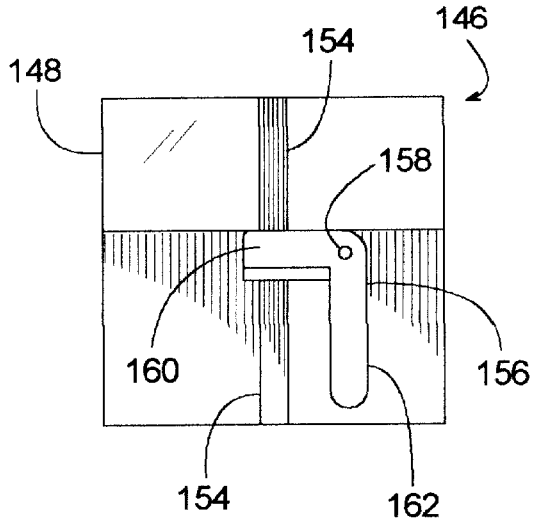
FIG. 11*a* is a front view of a catch in a less open position.
Figure 11B:
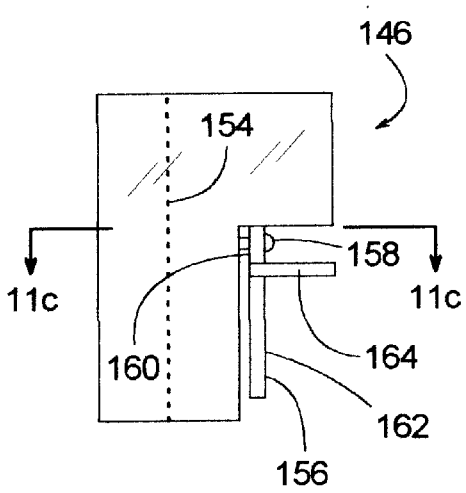
FIG. 11*b* is a side view of the catch in FIG. 11*a*.
Figure 11C:
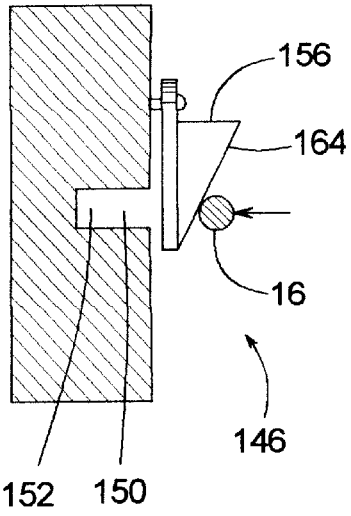
FIG. 11*c* is a cross-sectional view taken along line 11*c*—11*c*.
Figure 11D:
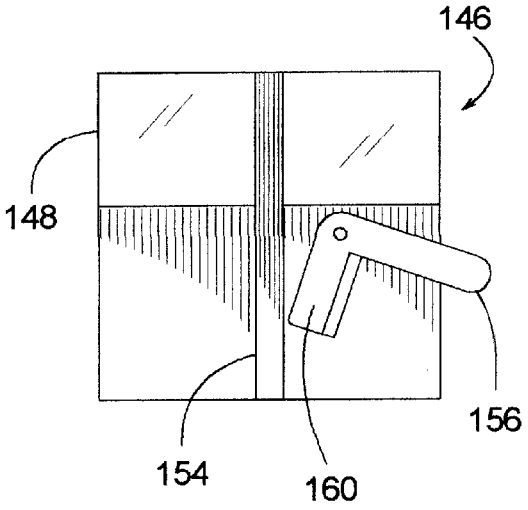
FIG. 11*d* is similar to FIG. 11 a but with the catch in a more open position.

In another embodiment, shown in FIGS. 11*a*, 11*b*, 11*c* and 11*d*, a catch 146 includes a housing 148 that defines a string-passageway 150 that leads to a string-capturing area 152. String-passageway 150 and string-capturing area 152 are basically a slot 154 in housing 148. Catch 146 also includes a latch 156 that can swing about a mounting pin 158. Latch 156 can swing under its own weight or be spring loaded (e.g., via a torsion spring). Latch 156 is movable relative to housing 148 so that a surface 160 of latch 156 can move to vary string-passageway 150 from being less open (FIGS. 11*a*, 11*b*, and 11*c*) to being more open (FIG. 11*d*). The weight of a lower arm 162 can urge latch 156 to the less open position. A cam surface 164, such as a bevel or curve, extends from latch 156, such that bowstring 16 exerting pressure on cam surface 64, as shown in FIG. 11*c*, urges latch 156 to swing open, as shown in FIG. 11*d*. Once bowstring 16 is within string-capturing area 152, latch 156 may swing back down to help hold bowstring 16 in place. Latch 156 can be manually swung open to release bowstring 16.

Figure 13:
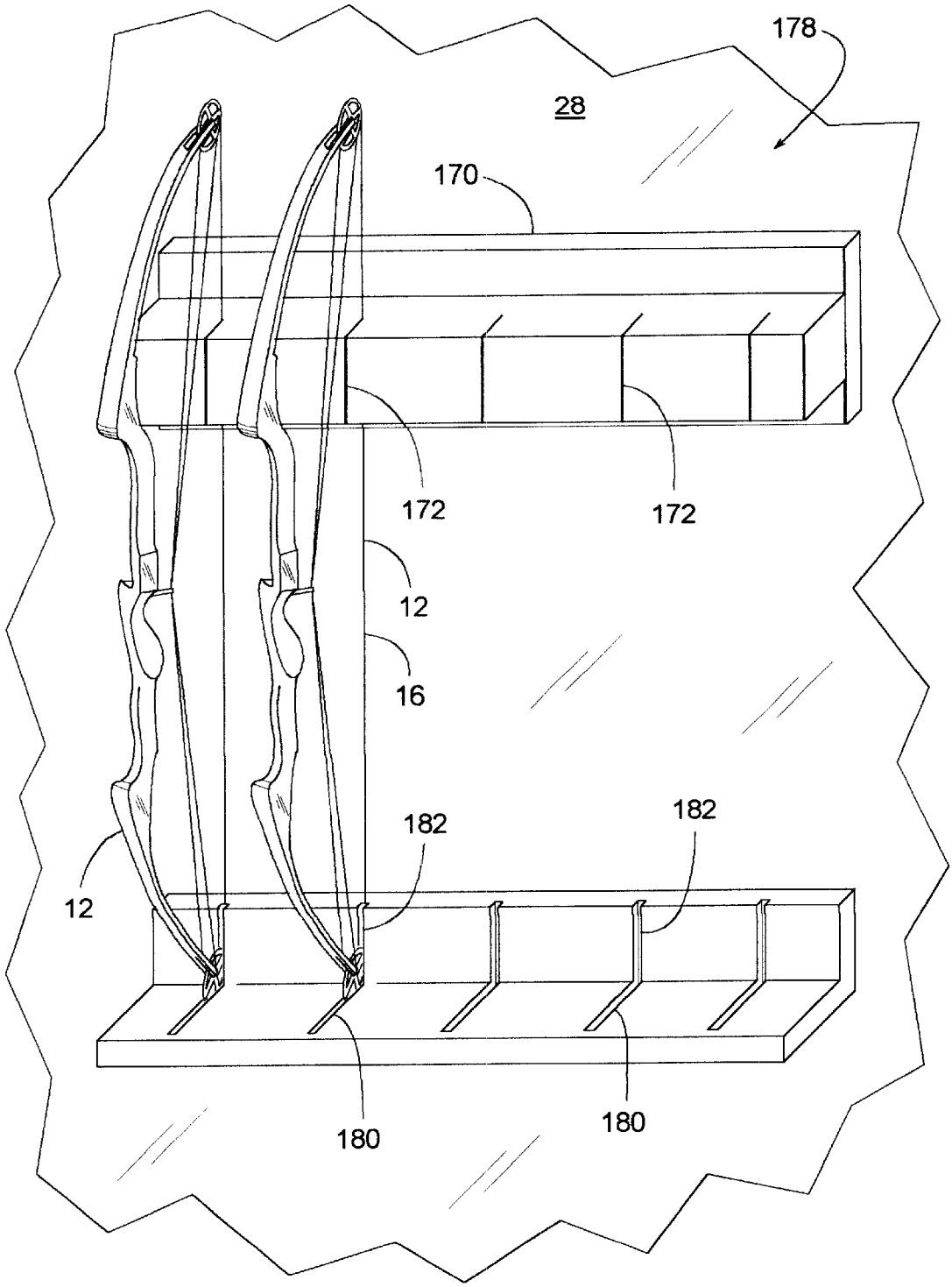
FIG. 13 is a perspective view of a rack according to some embodiments of the invention.

In the embodiment of FIGS. 12*a*, 12*b*, 12*c*, and 12*d*, catch 166 includes two roller assemblies 42 mounted facing each other within a crossbeam 170. Crossbeam 170 is horizontally elongate and defines a plurality of string-receiving slots 172 that traverse the crossbeam. The string-receiving slots are part of a string-passageway 174 that leads to a string-capturing area 176. Similar pairs of roller assemblies 42 can be installed at each string-receiving slot 172 to hold a plurality of bows in a substantially upright, side-by-side arrangement, as shown by a rack 178 of FIG. 13. Crossbeam 170 is preferably made of wood with the catches being installed within the crossbeam for appearance and to protect the bowstring from snagging on any exposed metal hardware. Catches 166 and 40 are similar with FIGS. 12*a*, 12*b* and 12*c* corresponding to FIGS. 4*a*, 4*b*, and 4*c* respectively.

Referring to FIG. 12*d*, lower support 26' preferably defines a lower sheave-receiving pocket 180 and an upper sheave-receiving slot 182 that can engage sheave 22 and/or bowstring 16 to help position bow 12. In some cases, catch 166 and lower support 26' are slightly offset to each other, as apparent by the offset appearance of bowstring 16 at break line 184 of FIG. 12*d*. Although not required, the horizontally staggered arrangement does enable the weight of bow 12 to urge the bow to swing naturally away from mounting surface 28 (analogous to a door that is improperly hung at an angle, whereby the door tends to swing to lower its center of gravity).

Figure 15:
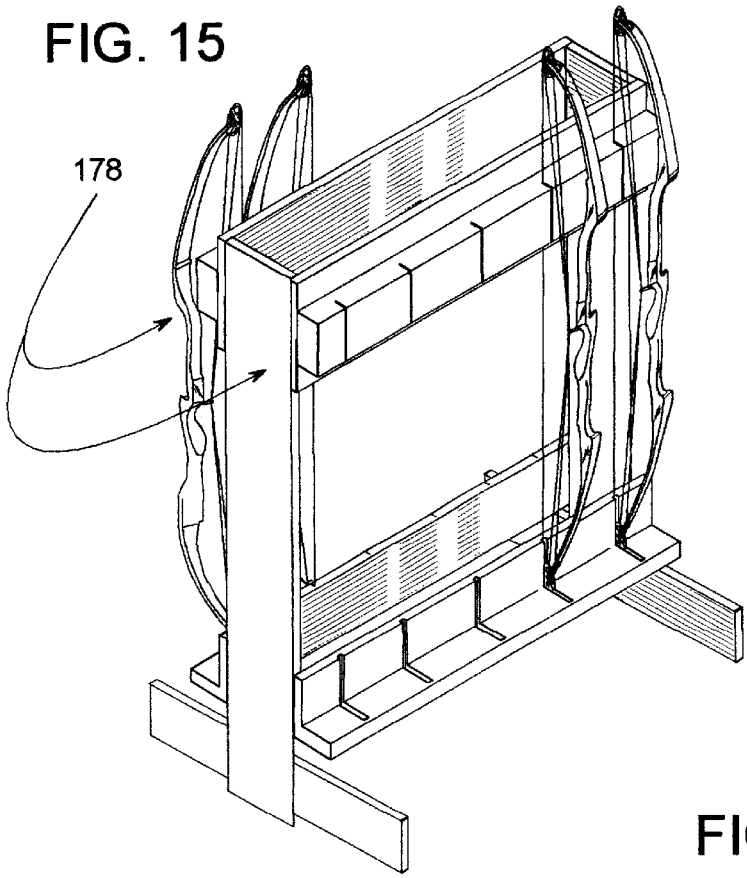
FIG. 15 is a perspective view of stand holding at least one rack.
Figure 14:
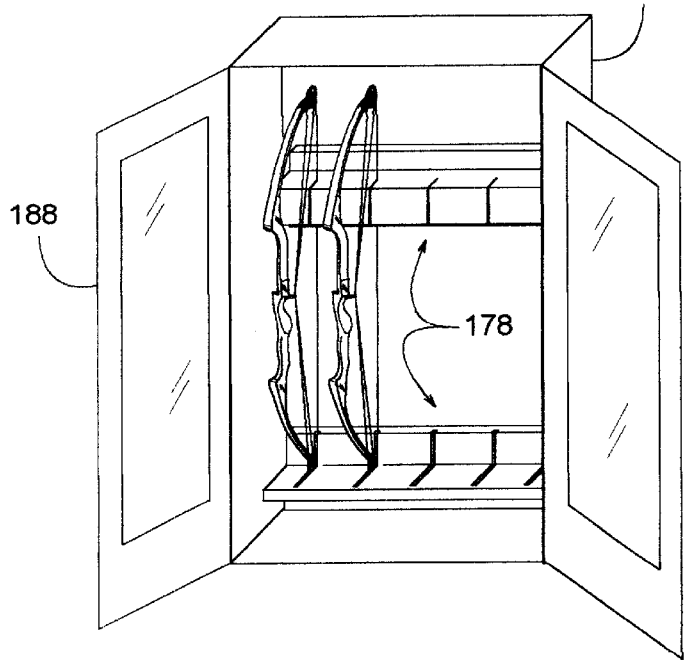
FIG. 14 is a perspective view of a rack installed in a cabinet.

FIG. 14 shows rack 178 mounted inside a cabinet 186 with an attached swinging door 188. FIG. 15 shows two racks 198 mounted back-to-back on a self-supporting stand 190. Upon viewing FIG. 15, it should appreciated by those skilled in the art that racks 178 can be arranged in infinite ways, including but not limited to, two racks back-to-back (FIG. 15), three rack arranged in a triangle where the three racks make up the three sides of the triangle, four racks arrange in a rectangle or square where the four racks make up the four sides of the square or rectangle, etc. Elongate crossbeam could also be curved to provide a circular bow rack.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A rack for storing an archery bow that includes a bow and a bowstring, the rack comprising:

a lower support member upon which the archery bow may rest its weight; and a catch defining a string-passageway and being disposed above the lower support member, wherein the catch is resiliently movable between a more open position and a less open position in response to the bowstring being forced through the string-passageway.

2. A rack for storing an archery bow that includes a bow and a bowstring, the rack comprising:

a lower support member upon which the archery bow may rest its weight; and a catch defining a string-capturing area and a string-passageway leading thereto;

a surface on the catch that is movable to vary the string-passageway from being less open to more open, wherein the string-passageway being more open allows the bowstring to pass therethrough to selectively enter and leave the string-capturing area, and when the string-passageway is less open the surface blocks the bowstring from passing through the string-passageway.

3. The rack of claim 2, wherein the catch includes a roller.

4. The rack of claim 2, wherein the catch includes a first roller and a second roller that define the string-passageway therebetween.

5. The rack of claim 2, further comprising a resilient member coupled to the roller to urge the roller to a position that makes the string-passageway less open.

6. The rack of claim 2, wherein the string-passageway is substantially closed when the string-passageway is less open.

7. The rack of claim 2, wherein the bowstring can become pinched within the string-passageway when the string-passageway is more open.

8. The rack of claim 2, wherein the catch includes two members that are resiliently urged toward each other.

9. The rack of claim 2, further comprising a crossbeam that is horizontally elongate and defines a plurality of string-receiving slots that traverse the crossbeam, wherein the catch is disposed within the crossbeam.

10. The rack of claim 9, wherein the crossbeam is wooden.

11. The rack of claim 2, wherein the catch includes a tapered lead-in for guiding the bowstring into the string-passageway.

12. The rack of claim 2, wherein the catch includes a curved lead-in for guiding the bowstring into the string-passageway.

13. The rack of claim 2, wherein the catch includes a magnet.

14. The rack of claim 2, wherein the lower support defines a lower sheave-receiving pocket to help position the bow.

15. The rack of claim 14, wherein the lower support defines an upper sheave-receiving slot that extends above the lower sheave-receiving pocket to help position the bow.

16. The rack of claim 2, wherein the catch includes an adjustment that determines the effort that may needed to force the bowstring through the string-passageway.

17. The rack of claim 2, wherein the surface is movable in response to forcing the bowstring through the string-passageway.

18. The rack of claim 2, wherein the catch includes a keyed lock.

19. The rack of claim 2, further comprising a first horizontally elongate crossbeam to which the catch is attached, wherein the catch is one of a plurality of catches distributed horizontally to hold a plurality of bows in a substantially upright, side-by-side arrangement.

20. The rack of claim 19, further comprising a second horizontally elongate crossbeam facing away from the first cross beam, wherein the plurality of catches are distributed horizontally across the first crossbeam and the second crossbeam to divide the plurality of bows into two groups and to support the two groups in a back-to-back arrangement.

21. The rack of claim 2, further comprising a cabinet with a swinging door attached thereto, wherein the lower support member and the catch are mounted inside the cabinet.

22. The rack of claim 2, further comprising a self-supporting stand to which the lower support member and the catch are attached.

23. A method of selectively inserting and removing an archery bow from a rack, wherein the rack includes a catch and a lower support member, and the archery bow includes a bow and a bowstring, the method comprising:

resting the bow on the lower support member;

forcing the bowstring into engagement with the catch such that the catch moves resiliently to capture the bowstring; and forcing the bowstring out of engagement with the catch such that the catch moves resiliently to release the bowstring.

* * * * *